United States Patent [19]

Degen et al.

[11] Patent Number: 4,818,341

[45] Date of Patent: Apr. 4, 1989

[54] PRODUCTION OF PAPER AND PAPERBOARD OF HIGH DRY STRENGTH

[75] Inventors: Hans-Juergen Degen, Lorsch; Sigberg Pfohl, Speyer; Volkmar Weberndoerfer, Mannheim; Gerd Rehmer, Bobenheim-Roxheim; Michael Kroener; Andreas Stange, both of Mannheim, all of Fed. Rep. of Germany

[73] Assignee: BASF Aktiengesellschaft, Ludwigshafen, Fed. Rep. of Germany

[21] Appl. No.: 155,503

[22] Filed: Feb. 12, 1988

[30] Foreign Application Priority Data

Feb. 28, 1987 [DE] Fed. Rep. of Germany ..... 3706525

[51] Int. Cl.[4] ..... D21D 3/00

[52] U.S. Cl. ..... 162/168.2; 162/168.3; 162/168.4; 162/168.5; 162/175

[58] Field of Search ..... 162/168.2, 164.6, 175, 162/164.3, 164.5, 168.3, 168.4, 168.5

[56] References Cited

U.S. PATENT DOCUMENTS 3,873,336 3/1973 Lambert et al. ..... 162/175 X
4,097,427 6/1978 Aitken et al. ..... 162/164.3 X

*Primary Examiner*—Peter Chin
*Assistant Examiner*—Thi Dang
*Attorney, Agent, or Firm*—Oblon, Fisher, Spivak, McClelland & Maier

[57] ABSTRACT

Paper and paperboard of high dry strength are produced by adding a dry strength enhancer to the paper stock and dewatering the paper stock with sheet formation by using as the dry strength enhancer a mixture of a cationic polymer which contains as characteristic monomers copolymerized units of (a) diallyldimethylammonium chloride,
(b) N-vinylamine or
(c) a substituted or unsubstituted N-vinylimidazoline and has a K value of not less than 30, and natural potato starch which is converted into a water-soluble form by heating in an aqueous medium at above the gelatinization temperature of natural potato starch in the absence of any oxidizing agents or alkali.

6 Claims, No Drawings

PRODUCTION OF PAPER AND PAPERBOARD OF HIGH DRY STRENGTH

To increase the dry strength of paper, it is known to use aqueous slurries of natural starches made water-soluble by heating as pulp additives in papermaking. However, the retention of the water-dissolved starches on the fibers in the paper stock is low. An improvement in the retention of natural products on cellulose fibers in papermaking is known for example from U.S. Pat. No. 3,734,820. Said patent described graft copolymers prepared by grafting dextran, a naturally occurring polymer having a molecular weight from 20,000 to 50 million, with cationic monomers, for example diallyldimethylammonium chloride, mixtures of diallyldimethylammonium chloride and acrylamide, or mixtures of acrylamide and basic methacrylates, such as dimethylaminoethyl methacrylate. The graft polymerization is preferably carried out in the presence of a redox catalyst.

U.S. Pat. No. 4,097,427 discloses a process for cationizing starch by boiling the starch in an alkaline medium in the presence of water-soluble quaternary ammonium polymers and an oxidizing agent. Possible quaternary ammonium polymers also include, inter alia, quaternized diallyldialkylamine polymers or quaternized polyethylene imines. The oxidizing agent used is for example ammonium persulfate, hydrogen peroxide, sodium hypochlorite, ozone or tert-butyl hydroperoxide. The modified cationic starches preparable in this manner are added as dry-strength enhancers to the paper stock in papermaking. However, they create a very high COD value in the waste water.

It is an object of the present invention to obtain an improvement in the dry strength of paper, compared with existing processes, by using starch. More particularly, the substantivity of the starch during exhaustion onto the fibers in the paper stock shall be increased and as a result the COD level in the waste water reduced.

We have found that this object is achieved according to the invention with a process for producing paper and paperboard of high dry strength by adding a dry-strength enhancer to the paper stock and dewatering the paper stock with sheet formation, by using as the dry-strength enhancer a mixture of a cationic polymer which contains as characteristic monomers copolymerized units of (a) diallyldimethylammonium chloride, (b) N-vinylamine or (c) an N-vinylimidazoline of the formula

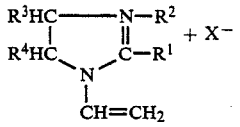

(I)

where $R^1$ is H, $C_1$–$C_{18}$-alkyl or

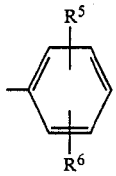

$R^5$ and $R^6$ are each H, $C_1$–$C_4$-alkyl or Cl, $R^2$ is H, $C_1$–$C_{18}$-alkyl,

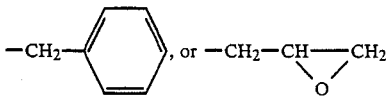

$R^3$ and $R^4$ are each H or $C_1$–$C_4$-alkyl and $X^-$ is an acid radical, and which has a K value of not less than 30, and natural potato starch converted into a water-soluble form by heating in an aqueous medium at above the gelatinization temperature of natural potato starch in the absence of any oxidizing agent, polymerization initiator or alkali.

The mixtures to be used according to the invention as dry-strength enhancers are well retained by the fibers in the paper stock. The COD value in the backwater is substantially reduced using the mixtures according to the invention compared with natural starch. The interfering substances present in the circulating water systems of paper machines impair the effectiveness of the dry-strength enhancers to be used according to the invention only to a small extent. The pH of the paper stock suspension can be within the range from 4 to 9, preferably from 6 to 8.5.

As was found in a series of experiments, the stated object is only achieved when the starch used is natural potato starch. Unlike the abovementioned existing starch modification processes, the preparation of the modified starch to be used according to the invention is carried out in the absence of oxidizing agents and polymerization initiators and even in the absence of alkali.

The modification of natural potato starch is preferably achieved by heating said starch in aqueous suspension together with one or more of the cationic polymers which come into consideration at above the gelatinization temperature of the starch, the gelatinization temperature of a starch being that temperature at which the birefringence of the starch grains disappears (cf. Ullmann's Enzyklopadie der technischen Chemie, Urban und Schwarzenberg, Munich/Berlin, 1965, volume 16, page 322.

However, in general the modification of natural potato starch can be carried out in various ways. A previously digested natural potato starch which is present in the form of an aqueous solution can be made to react with one or more of the cationic polymers which come into consideration at from 15° to 70° C. Still lower temperatures require longer contact times. If the reaction is carried out at still higher temperatures, for example up to 110° C., shorter contact times, for example from 0.1 to 15 minutes, are required. The simplest method of modifying natural potato starch comprises heating an aqueous slurry of the starch in the presence of one or more of the cationic polymers which come into consideration at above the gelatinization temperature of natural potato starch. In general, the temperatures involved in modifying the starch range from 70° to 110° C., in the case of temperatures above 100° C. the reaction being carried out in pressure-tight apparatus. However, it is also possible first to heat an aqueous slurry of natural potato starch at from 70° to 110° C. to solubilize the starch and then to add the cationic polymer required for effecting modification. This solubilizing of the starch always takes place in the absence of any oxidizing agents, initiators and alkali in the course of from about 3 minutes to 5 hours, preferably from 5 minutes to 30 minutes. High temperatures here require a shorter residence time. The amounts used per 100 parts by weight of natural potato starch range from 1 to 20, preferably 8 to 12, parts by weight of a single polymer or of a mixture of the cationic polymers which come into consideration. The heating and/or reacting with the cationic polymers has the effect of converting the natural potato starch into a water-soluble form. This water-solubilization is accompanied by an increase in the viscosity of the aqueous phase of the reaction mixture. A 3.5% strength by weight aqueous solution of the mixture to be used as dry-strength enhancer has a viscosity within the range from 50 to 10,000 mPas (measured by Brookfield at 20 rpm and 20° C.).

To prepare the dry-strength enhancers to be used according to the invention there come into consideration (a) polymers of diallyldimethylammonium chloride. Polymers of this type are known. For the purposes of the present invention, polymers of diallyldimethylammonium chloride are first and foremost the homopolymers and the copolymers with acrylamide and/or methacrylamide. The copolymerization may be carried out using any desired monomer ratio. The K value of the homopolymers and copolymers of diallyldimethylammonium chloride is not less than 30, preferably from 95 to 180.

Cationic polymers of group (b), which contain as characteristic monomers copolymerized units of N-vinylamine, are obtainable by hydrolyzing homopolymers of N-vinylformamide to detach from 70 to 100 mol % of the formyl groups in the homopolymers of N-vinylformamide to give polymers containing N-vinylamine as copolymerized units. As soon as 100 mol % of the formyl groups have been eliminated from the homopolymers of N-vinylformamide, the resulting polymers may also be referred to as poly-N-vinylamines. This group of polymers also includes hydrolyzed copolymers which contain (a) from 95 to 10 mol % of N-vinylformamide and
(b) from 5 to 90 mol % of vinyl acetate or vinyl propionate as copolymerized units, from 70 to 100 mol % of the formyl groups in the copolymer being eliminated to form N-vinylamine units in the copolymer, and from 70 to 100 mol % of the acetyl and propionyl groups being eliminated to form vinyl alcohol units. The K value of the hydrolyzed homopolymers and copolymers of N-vinylformamide is preferably from 70 to 170. The polymers belonging to this group are known for example from U.S. Pat. No. 4,421,602, U.S. Pat. No. 4,444,667 (incorporated by reference) and German Laid-Open Application DOS No. 3,534,273.

Suitable cationic polymers of group (c) comprise homopolymers and copolymers of substituted or unsubstituted N-vinylimidazolines. The substances in question here are again known substances. They can be prepared as described in German Published Application DAS No. 1,182,826 by polymerizing compounds of the formula

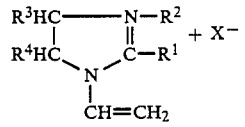

(I)

where $R^1$ is H, $C_1$–$C_{18}$-alkyl or

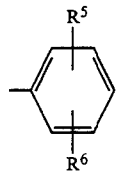

$R^5$ and $R^6$ are each H, $C_1$–$C_4$-alkyl or Cl, $R^2$ is H, $C_1$–$C_{18}$-alkyl,

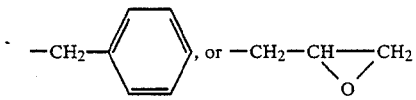

$R^3$ and $R^4$ are each H or $C_1$–$C_4$-alkyl, and $X^-$ is an acid radical, with or without acrylamide and/or methacrylamide, in an aqueous medium at a pH from 0 to 8, preferably from 1.0 to 6.8, in the presence of polymerization initiators which decompose to free radicals.

Preference is given to using in the polymerization 1-vinyl-2-imidazoline salts of the formula II

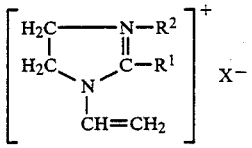

(II)

where $R^1$ is H, $CH_3$, $C_2H_5$, n- or i-$C_3H_7$ or $C_6H_5$ and $X^-$ is an acid radical. $X^-$ is preferably $Cl^-$, $Br^-$, $SO_4^{2-}$, $CH_3O—SO_3H^-$, $C_2H_5—O—SO_3H^-$ or $R—COO^-$ and $R^2$ is H, $C_1$–$C_4$-alkyl or aryl.

The substituent $X^-$ in the formulae I and II may in principle be any desired acid radical of an inorganic or organic acid. The monomers of the formula I are obtained by neutralizing the free base, ie. 1-vinyl-2-imidazolines, with an equivalent amount of an acid. The vinylimidazolines can also be neutralized for example with trichloroacetic acid, benzenesulfonic acid or toluenesulfonic acid. Aside from salts of 1-vinyl-2-imidazolines it is also possible to use quaternized 1-vinyl-2-imidazolines. They are prepared by reacting 1-vinyl-2-imidazolines, which may be substituted in the 2-, 4- and 5-positions, with known quaternizing agents. Suitable quaternizing agents are for example $C_1$–$C_{18}$-alkyl chlorides or bromides, benzyl chloride, benzyl bromide, epichlorohydrin, dimethyl sulfate and diethyl sulfate. The quaternizing agent used is preferably epichlorohydrin, benzyl chloride, dimethyl sulfate or methyl chloride.

To prepare the water-soluble homopolymers, the compounds of the formula I or II are preferably polymerized is an aqueous medium. The copolymers are obtained by polymerizing the monomers of the compounds of the formulae I and II with acrylamide and/or methacrylamide. The monomer mixture used in the polymerization contains, if copolymers are to be prepared, not less than 1% by weight of a monomer of the formula I or II, preferably from 10 to 40% by weight. Particularly suitable for modifying natural potato starch are copolymers of from 60 to 85% by weight of acrylamide and/or methacrylamide and 15 to 40% by weight of N-vinylimidazoline or N-vinyl-2-methylimidazoline.

The copolymers can additionally be modified by inclusion, as copolymerized units, of other monomers, such as styrene, vinyl acetate, vinyl propionate, N-vinylformamide, $C_1$–$C_4$-alkyl vinyl ethers, N-vinylpyridine, N-vinylpyrrolidone, N-vinylimidazole, acrylic esters, methacrylic esters, ethylenically unsaturated $C_3$–$C_5$-carboxylic acids, sodium vinyl sulfonate, acrylonitrile, methacrylonitrile, vinyl chloride or vinylidene chloride, in amounts of up to 25% by weight. Aside from the polymerization in aqueous solution it is possible for example to prepare the homopolymers and copolymers in a water-in-oil emulsion. The monomers can also be polymerized by the method of reverse suspension polymerization, which produces polymers in bead form. The polymerization is initiated with the aid of customary polymerization initiators or by the action of high-energy radiation. Suitable polymerization initiators are for example hydrogen peroxide, inorganic and organic peroxides, and also hydroperoxides and azo compounds. It is possible to use not only mixtures of polymerization initiators but also redox polymerization initiators, for example mixtures of sodium sulfide, ammonium persulfate and sodium bromate or mixtures of potassium peroxodisulfate and iron (II) salts. The polymerization is carried out at from 0° to 100° C., preferably at from 15° to 80° C. It is of course also possible to polymerize at above 100° C., although then it is necessary to carry out the polymerization under superatmospheric pressure. The temperature can be for example as high as 150° C. The reaction time depends on the temperature. The higher the temperature, the shorter the time required for the polymerization.

Since the compounds of the formula I are relatively costly, it is preferable, for economic reasons, to use as cationic polymers of group (c) copolymers of compounds of the formula I with acrylamide or methacrylamide. These copolymers then contain the compounds of the formula I only in active amounts, ie. in an amount from 1 to 40% by weight. In the preparation of the dry-strength enhancers to be used according to the invention preference is given to using copolymers of acrylamide with compounds of the formula I where $R^1$ is methyl, $R^2$, $R^3$ and $R^4$ are each H, and X is an acid radical, preferably chloride or sulfate.

To modify natural potato starch it is also possible to employ copolymers which contain (a) from 70 to 96.5% by weight of acrylamide and/or methacrylamide, (b) from 2 to 20% by weight of N-vinylimidazoline or N-vinyl-2-methylimidazoline and (c) from 1.5 to 10% by weight of N-vinylimidazole as copolymerized units with the proviso that the sum of (a) to (c) in percent by weight always adds up to 100, and which have a K value from 80 to 150. These copolymers are prepared by free radical copolymerization of monomers (a), (b) and (c) by the polymerization process described above. To prepare the mixtures to be used according to the invention as dry-strength enhancers, the starting point is an aqueous slurry of natural potato starch which, per 100 parts by weight of water, contains from 0.1 to 10 parts by weight of natural potato starch. As stated above, the advantages of the invention are not realized with any other type of starch. The reaction mixtures of the polymers described above and natural potato starch which are to be used according to the invention are added to the paper stock in an amount from 0.5 to 3.5, preferably from 1.2 to 2.5, % by weight, based on dry paper stock. The pH of the mixture ranges from 2.0 to 9.0, preferably from 2.5 to 8.0. The solution of the dry-strength enhancer in water in a solids concentration of 3.5% by weight has a viscosity from 50 to 10,000, preferably from 80 to 4,000, mPas, measured in a Brookfield viscometer as 20 rpm and 20° C.

The dry-strength enhancers to be used according to the invention can be used in the production of all known types of paper and paperboard, for example writing, printing and packaging papers. The various types and grades of paper can be produced from a wide variety of fiber materials, for example from sulfite or sulfate pulp in the bleached or unbleached state, groundwood, wastepaper, thermomechanical pulp (TMP) or chemothermomechanical pulp (CTMP). The pH of the stock suspension is within the range from 4.0 to 10, preferably from 6.0 to 8.5. The dry-strength enhancers can be used not only in the production of base paper for paper varieties of low basis weight (LWC papers) but also for paperboard. The basis weight for paper ranges from 30 to 200, preferably from 35 to 150, g/m$^2$, while for paperboard it can be up to 600 g/m$^2$. The paper products produced according to the invention have a substantially improved strength compared with paper produced in the presence of the same amount of natural potato starch, as can be quantitatively expressed for example in terms of their breaking length, the burst pressure, the CMT value and the tear propagation resistance.

In the Examples, the parts and percentages are by weight. The viscosities of the strength enhancers were determined in aqueous solution at a solids concentration of 3.5% by weight and at 20° C. in a Brookfield viscometer at 20 rpm.

The sheets were produced in a Rapid-Köthen laboratory sheet former. The dry breaking length was determined in accordance with German Standard Specification DIN No. 53,112 Sheet 1, the dry burst pressure by the Mullen method (German Standard Specification DIN No. 53,141), the CMT value in accordance with German Standard Specification DIN No. 53,143 and the tear propagation resistance by the Brecht-Inset method in accordance with German Standard Specification DIN No. 53,115.

The sheets were each tested after 24 hours conditioning at a temperature of 23° C. and a relative humidity of 50%.

The K value of the polymers was determined by the method of H. Fikentscher, Cellulosechemie, 13 (1932), 58–64 and 71–74, at 25° C. in 5% strength aqueous sodium chloride solution at a polymer concentration of 0.5% by weight, K being $=k\times10^3$.

The following substances were used:

Polymer 1

Homopolymer of diallyldimethylammonium chloride having a K value of 95.

Polymer 2

Homopolymer of diallyldimethylammonium chloride having a K value of 110.

Polymer 3

Homopolymer of diallyldimethylammonium chloride having a K value of 125.

Polymer 4

Copolymer of 90% by weight of acrylamide, 8% by weight of N-vinyl-2-methylimidazoline and 2% by weight of N-vinylimidazole, having a K value of 119.

Polymer 5

Copolymer of 25 mol % of N-vinyl-2-methylimidazoline and 75 mol % of acrylamide, having a K value of 117.

Polymer 6

Homopolymer of N-vinylformamide from which 99% of the formyl groups have been eliminated and which has a K value of 83.

Polymer 7

Homopolymer of N-vinylformamide from which 83% of the formyl group have been eliminated and which has a K value of 168.

Polymer 8

Copolymer of 40% by weight of N-vinylformamide and 60% by weight of vinyl acetate, from which 100% of the formyl groups and 98% of the acetyl groups have been eliminated and which has a K value of 75.

Polymer 9 (comparison)

Copolymer of 30% by weight of dimethylaminoethyl acrylate methochloride and 70% by weight of acrylamide, which has a K value of 205.

Strength enhancer 1

To a 3% strength slurry of natural potato starch (gelatinization temperature 90° C.) in water is added to a sufficient amount of polymer 1 for the resulting mixture to contain 10% of polymer 1, based on the starting amount of natural potato starch. The mixture is then heated with stirring at from 90° to 95° C. for 15 minutes and, after cooling down to within the range from 10° to 40° C., used in accordance with the invention as a dry-strength enhancer for paper by being added to a stock suspension prior to sheet formation (viscosity: 656 mPa.s).

Strength enhancer 2

The procedure for preparing a dry-strength enhancer for paper described above for strength enhancer 1 is repeated, except that here a 3% strength aqueous slurry of natural potato starch is reacted not with polymer 1 used there but with polymer 2 (viscosity: 870 mPa.s).

Strength enhancer 3

The procedure for preparing a dry-strength enhancer for paper described above for strength enhancer 1 is repeated, except that here the polymer 1 described there is replaced by polymer 3 (viscosity: 950 mPa.s).

Strength enhancer 4

The procedure for preparing a dry-strength enhancer described above for strength enhancer 1 is repeated, except that the polymer used there is replaced by polymer 4 (viscosity: 398 mPa.s).

Strength enhancer 5

A 3% strength aqueous slurry of natural potato starch (gelatinization temperature 90° C.) is heated with stirring at from 90° to 95° C. for 15 minutes, during which the starch becomes solubilized. After the starch solution has been cooled down to 70° C., a 5% strength aqueous solution of polymer 2 is added in such an amount that the amount of polymer based on the starting amount of natural potato starch, is 10%. The mixture is then stirred at 70° C. for a further 10 minutes and thereafter cooled down to room temperature. A dry-strength enhancer for paper is obtained (viscosity: 784 mPa.s).

Strength enhancer 6

The procedure for preparing a dry-strength enhancer described in the preparation of strength enhancer 1 is repeated, except that here the polymer used there is replaced by polymer 5 (viscosity: 250 mPa.s).

Strength enhancer 7

The procedure for preparing a dry-strength enhancer described in the preparation of strength enhancer 1 is repeated, except that here the polymer used there is replaced by polymer 6 (viscosity: 150 mPa.s).

Strength enhancer 8

The procedure for preparing a dry-strength enhancer described in the preparation of strength enhancer 1 is repeated, except that here the polymer used there is replaced by polymer 7 (viscosity: 206 mPa.s).

Strength enhancer 9

The procedure for preparing a dry-strength enhancer described in the preparation of strength enhancer 1 is repeated, except that here the polymer used there is replaced by polymer 8 (viscosity: 86 mPa.s).

Strength enhancer 10

For comparison, a dry-strength enhancer for paper is prepared by the procedure described for strength enhancer 1, except that the polymer used there is replaced by polymer 9 (viscosity: 766 mPa.s).

Strength enhancer 11 (comparison)

For comparison, a dry-strength enhancer for paper is prepared by the method described in Example 7 of U.S. Pat. No. 4,097,427 using polymer 3 in an amount of 6.6%, based on starch, 5% of sodium hydroxide, based on starch, and ammonium persulfate as oxidizing enhancer (viscosity: 30 mPa.s).

Strength enhancer 12

A dry-strength enhancer for paper is prepared as described above for strength enhancer 1, except that here the polymer 1 described there is replaced by polymer 3, which is used in such an amount that the resulting mixture, instead of 10%, here contains only 6.6% of polymer 3, based on starch (viscosity: 985 mPa.s).

Strength enhancer 13 (comparison)

A dry-strength enhancer is prepared as described in the preparation of strength enhancer 6, except that here the natural potato starch used there is replaced by natural corn starch (viscosity: 290 mPa.s).

Strength enhancer 14 (comparison)

A dry-strength enhancer is prepared as described in the preparation of strength enhancer 6, except that here the natural potato starch used there is replaced by natural wheat starch (viscosity: 220 mPa.s).

EXAMPLE 1

A Rapid-Köthen sheet former was used to produce sheets having a basis weight of 120 g/m$^2$. The paper stock comprises 80% of mixed wastepaper and 20% of bleached beech sulfite pulp which has been beaten to a freeness of 50° SR (Schopper-Riegler) and to which the strength enhancer 1 described above is added in such an amount that the solids content in terms of strength enhancer 1 is 2.2%, based on dry paper stock. The pH of the stock suspension is adjusted to 7.6. The sheets produced from this model stock are conditioned and thereafter measured in respect of the CMT value, the dry burst strength and the dry breaking length by the methods specified above. The results are reported in Table 1.

EXAMPLES 2 to 9

Example 1 is repeated each time, except that the strength enhancer 1 used in Example 1 is replaced by one of the strength enhancers indicated in Table 1. The results thus obtained are reported in Table 1.

COMPARATIVE EXAMPLE 1

Example 1 is repeated without addition of a dry-strength enhancer; that is, a stock comprising 80% of mixed wastepaper and 20% of bleached beech sulfite pulp beaten to a freeness of 50° SR is dewatered in a Rapid-Köthen sheet former to produce sheets having a basis weight of 120 g/m². The results of the strength tests on the sheets thus obtained are reported in Tables 1 and 2.

COMPARATIVE EXAMPLE 2

Comparative Example 1 is repeated, except that the paper stock is treated with 2% of natural potato starch, based on dry fiber substance. The strength values of the sheets of paper thus obtained are reported in Table 1.

COMPARATIVE EXAMPLE 3

Example 1 is repeated, except that the strength enhancer described therein is replaced by the same amount of strength enhancer 10. The strength values of sheets thus obtained are reported in Table 1.

COMPARATIVE EXAMPLE 4

Example 1 is repeated, except that the dry-strength enhancer specified therein is replaced by the same amount of strength enhancer 11. The strength values of sheets of paper prepared in this way are reported in Table 2.

EXAMPLE 10

Example 1 is repeated, except that the strength enhancer described therein is replaced by the same amount of strength enhancer 12. The strength values of sheets thus obtained are reported in Table 2.

TABLE 1

| | Number of strength enhancer added to paper stock | CMT value [N] | Dry burst pressure [kPa] | Dry breaking length [m] |
|---|---|---|---|---|
| Example | | | | |
| 1 | 1 | 171 | 160 | 3263 |
| 2 | 2 | 164 | 165 | 3314 |
| 3 | 3 | 162 | 167 | 3379 |
| 4 | 4 | 161 | 159 | 3152 |
| 5 | 5 | 172 | 160 | 3180 |
| 6 | 6 | 168 | 165 | 3328 |
| 7 | 7 | 161 | 173 | 3037 |
| 8 | 8 | 165 | 166 | 3071 |
| 9 | 9 | 159 | 167 | 3167 |
| Comparative Example | | | | |
| 1 | — | 126 | 128 | 2531 |
| 2 | natural potato starch | 125 | 140 | 2840 |
| 3 | 10 | 147 | 149 | 2907 |

TABLE 2

| | Number of strength enhancer added to paper stock | CMT value [N] | Dry burst pressure [kPa] |
|---|---|---|---|
| Example | | | |
| 10 | 12 | 151 | 158 |
| Comparative Example | | | |
| 1 | — | 123 | 131 |
| 4 | 11 | 137 | 139 |

EXAMPLE 11

Example 1 is repeated, except that the strength enhancer described therein is replaced by the same amount of strength enhancer 12 and that instead of the paper stock consisting of 80% of mixed wastepaper and 20% of bleached beech sulfite pulp, a paper stock which consists 100% of unbleached softwood sulfate and which has been beaten to a freeness of 30° SR (Schopper-Riegler) is used for sheet formation, and the sheets formed therefrom have a basis weight of 100 g/m². The strength values of these sheets are reported in Table 3.

COMPARATIVE EXAMPLE 5

Example 1 is repeated, except that the strength enhancer described therein is replaced by the same amount of strength enhancer 11 and that instead of using the paper stock consisting 80% of mixed wastepaper and 20% of bleached beech sulfite pulp a paper stock which consists of 100% of unbleached softwood sulfate and which has been beaten to a freeness of 30° SR (Schopper-Riegler) is used for sheet formation and the sheets formed therefrom have a basis weight of 100 g/m². The strength values of these sheets are reported in Table 3.

COMPARATIVE EXAMPLE 6

Comparative Example 1 is repeated, except that instead of using the paper stock consisting 80% of mixed wastepaper and 20% of bleached beech sulfite pulp a paper stock which consists of 100% of unbleached softwood sulfate and which has been beaten to a freeness of 30° SR (Schopper-Riegler) is used for sheet formation and the sheets formed therefrom have a basis weight of 100 g/m². The results of the increase in strength measured on the sheets thus obtained are reported in Table 3.

TABLE 3

| | Number of strength enhancer added to paper stock | Dry burst pressure [kPa] | Dry breaking length [m] |
|---|---|---|---|
| Example | | | |
| 11 | 12 | 623 | 8637 |
| Comparative Example | | | |
| 5 | 11 | 576 | 8203 |
| 6 | — | 504 | 7535 |

EXAMPLE 12

Using an experimental paper machine, paper having a basis weight of 120 g/m² and a width of 68 cm is produced at a paper machine speed of 50 m/min. The paper stock used comprises 80% mixed wastepaper and 20% bleached sulfite pulp having a freeness of 50° SR. Prior to sheet formation, the paper stock is treated with strength enhancer 1 in an amount of 2.2%, based on dry paper stock. The backwater has a pH of 7.6. The strength values of the paper thus produced are reported in Table 4.

EXAMPLE 13

Example 12 is repeated, except that the same amount of strength enhancer 3 is used. The strength values of the paper thus produced are reported in Table 4.

EXAMPLE 14

Example 12 is repeated, except that the dry-strength enhancer used there is replaced by strength enhancer 4. The strength values of the paper thus obtained are reported in Table 4.

EXAMPLE 15

Example 12 is repeated, except that the dry-strength enhancer used there is replaced by strength enhancer 6. The strength values of the paper thus obtained are reported in Table 4.

COMPARATIVE EXAMPLE 7

The experimental paper machine described in Example 12 is used to produce paper having a basis weight of 120 g/m$^2$ from a paper stock which is 80% mixed wastepaper and 20% bleached beech sulfite pulp of freeness 50° SR. The paper machine speed is set to 50 m/min and the pH of the backwater is 7.6. The difference from Example 12 is that no dry-strength enhancer is used. The strength values of the paper thus obtained are reported in Table 4.

COMPARATIVE EXAMPLE 8

Comparative Example 7 is repeated, except that, before dewatering, the paper stock described therein is additionally treated with 2% of natural potato starch, based on dry fiber substance. The strength values of the paper thus obtained are reported in Table 4.

COMPARATIVE EXAMPLE 9

Comparative Example 7 is repeated, except that, before dewatering, the paper stock described therein is additionally treated with 2% of natural corn starch, based on dry fiber substance. The strength values of the paper thus obtained are reported in Table 4.

COMPARATIVE EXAMPLE 10

Comparative Example 7 is repeated, except that, before dewatering, the paper stock described therein is additionally treated with 2% of natural wheat starch, based on dry fiber substance. The strength values of the paper thus obtained are reported in Table 4.

COMPARATIVE EXAMPLE 11

Example 12 is repeated, except that strength enhancer 1 is replaced by the same amount of strength enhancer 13. The strength values of the paper thus obtained are reported in Table 4.

COMPARATIVE EXAMPLE 12

Example 12 is repeated, except that strength enhancer 1 is replaced by the same amount of strength enhancer 14. The strength values of the paper thus obtained are reported in Table 4.

TABLE 4

| | Number of strength enhancer used | CMT value [N] | Dry burst pressure [kPa] | Dry breaking length [m] | COD value in backwater [mg/l] |
|---|---|---|---|---|---|
| Example | | | | | |
| 12 | 1 | 139 | 163 | 3381 | 139 |
| 13 | 3 | 177 | 151 | 3151 | 130 |
| 14 | 4 | 130 | 147 | 3278 | 146 |
| 15 | 6 | 202 | 161 | 3488 | 134 |
| Comparative Example | | | | | |
| 7 | — | 109 | 129 | 2425 | 129 |
| 8 | natural potato starch | 110 | 118 | 2823 | 320 |
| 9 | natural corn starch | 112 | 105 | 2672 | 287 |
| 10 | natural wheat starch | 119 | 117 | 2652 | 256 |
| 11 | 13 | 122 | 115 | 2732 | 185 |
| 12 | 14 | 117 | 121 | 2767 | 172 |

EXAMPLE 16

The experimental paper machine described in Example 12 is used to produce an LWC paper from the following model stock: 40% of bleached groundwood, 30% of bleached softwood sulfite pulp and 30% of bleached birch sulfate pulp of freeness 35° SR. Based on dry fiber substance, an additional 20% of china clay and 0.3% of a commercial cationic polyacrylamide having a K value of 120 and in the form of a 7% strength aqueous solution. Additionally, 0.5% of alum is added, so that the drainage water has a pH of 6. Before dewatering on the paper machine wire, the paper stock is treated with strength enhancer 1 in an amount of 2.2%, based on dry fiber substance. A production speed on the paper machine of 60 m/min produces paper having a basis weight of 50 g/m$^2$, the strength values of which are reported in Table 5.

EXAMPLE 17

Example 16 is repeated, except that the strength enhancer used therein is replaced by the same amount of strength enhancer 2. The dry strength values of the paper thus obtained are reported in Table 5.

EXAMPLE 18

Example 16 is repeated, except that the strength enhancer specified therein is replaced by strength enhancer 4, affording an LWC paper whose dry strength values are reported in Table 5.

COMPARATIVE EXAMPLE 13

Example 16 is repeated, except that an LWC paper is produced in the absence of any dry-strength enhancer. The strength values of the paper thus obtained are reported in Table 5.

COMPARATIVE EXAMPLE 14

Example 16 is repeated, except that here strength enhancer 1 used there is replaced by 2% of natural potato starch, based on dry fiber substance. The strength values of the LWC paper thus obtained are reported in Table 5.

TABLE 5

| | Number of strength enhancer used | Dry burst pressure [kPa] | Dry breaking length [m] | Tear propagation resistance [mJ/m] |
|---|---|---|---|---|
| Example | | | | |
| 16 | 1 | 52 | 2913 | 417 |
| 17 | 2 | 51 | 2781 | 409 |
| 18 | 4 | 54 | 2943 | 423 |
| Comparative Example | | | | |
| 13 | — | 39 | 2270 | 338 |
| 14 | natural potato starch | 46 | 2558 | 398 |

We claim:

1. A process for producing paper and paperboard of high dry strength by adding a mixture of from 1 to 20 parts by weight of a cationic polymer which contains as characteristic monomers copolymerized units of (a) diallyldimethylammonium chloride, (b) N-vinylamine or (c) an N-vinylimidazoline of the formula

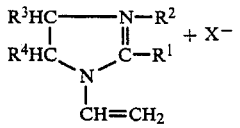

(I)

where $R^1$ is H, $C_1$–$C_{18}$-alkyl or

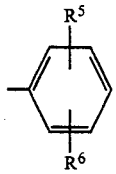

$R^5$ and $R^6$ are each H, $C_1$–$C_4$-alkyl or Cl, $R^2$ is H, $C_1$–$C_{18}$-alkyl,

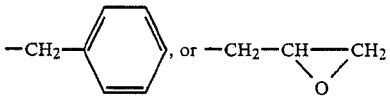

$R^3$ and $R^4$ are each H or $C_1$–$C_4$-alkyl and $X^-$ is an acid radical, and which has a K value of not less than 30, and 100 parts by weight of natural potato starch which is converted into a water-soluble form by heating in an aqueous medium at above the gelatinization temperature of natural potato starch in the absence of any oxidizing agent, polymerization initiator or alkali, as a dry strength enhancer to the paper stock and dewatering the paper stock with sheet formation.

2. A process as claimed in of claim 1, wherein the dry strength enhancer used is a mixture obtainable by heating natural potato starch in the presence of a homopolymer of diallyldimethylammonium chloride having a K value of from 60 to 180.

3. A process as claimed in claim 1, wherein the dry-strength enhancer used is a mixture obtainable by heating natural potato starch in the presence of a homopolymer of N-vinylformamide in which from 70 to 100 mol % of the formyl groups on the polymer have been eliminated to form N-vinylamine units, the hydrolyzed polymer having a K value from 75 to 170.

4. A process as claimed in claim 1, wherein the dry-strength enhancer used is a mixture obtainable by heating natural potato starch in the presence of a hydrolyzed copolymer which contains (a) from 95 to 10 mol % of N-vinylformamide and (b) from 5 to 90 mol % of vinyl acetate or vinyl propionate as copolymerized units, from 70 to 100 mol % of the formyl groups in the polymer having been eliminated to form N-vinylamine units and from 70 to 100 mol % of the acetyl and propionyl groups having been eliminated to form vinyl alcohol units, and the hydrolyzed polymer having a K value from 70 to 170.

5. A process as claimed in claim 1, wherein the dry-strength enhancer used is a mixture obtainable by heating natural potato starch in the presence of a homopolymer of a substituted or unsubstituted N-vinylimidazoline or of a copolymer thereof with acrylamide and/or methacrylamide having a K value from 80 to 220.

6. A process as claimed in claim 1, wherein the dry-strength enhancer used is a mixture obtainable by heating natural potato starch in the presence of a copolymer comprising (a) from 70 to 96.5% by weight of acrylamide and/or methacrylamide, (b) from 2 to 20% by weight of N-vinylimidazoline or N-vinyl-2-methylimidazoline and (c) from 1.5 to 10% by weight of N-vinylimidazole and having a K value from 80 to 220.

* * * * *